US010675682B2

(12) United States Patent
Nakamura et al.

(10) Patent No.: US 10,675,682 B2
(45) Date of Patent: Jun. 9, 2020

(54) COMPOUND FOR METAL POWDER INJECTION MOLDING, METAL POWDER MOLDED BODY, METHOD FOR PRODUCING SINTERED BODY, AND SINTERED BODY

(71) Applicant: Seiko Epson Corporation, Tokyo (JP)

(72) Inventors: Hidefumi Nakamura, Hachinohe (JP); Yasutoshi Hideshima, Matsumoto (JP)

(73) Assignee: Seiko Epson Corporation (JP)

( * ) Notice: Subject to any disclaimer, the term of this patent is extended or adjusted under 35 U.S.C. 154(b) by 140 days.

(21) Appl. No.: 15/902,338

(22) Filed: Feb. 22, 2018

(65) Prior Publication Data

US 2018/0243824 A1 Aug. 30, 2018

(30) Foreign Application Priority Data

Feb. 24, 2017 (JP) ..... 2017-033916

(51) Int. Cl.
*B22F 1/00* (2006.01)
*B22F 3/22* (2006.01)
(Continued)

(52) U.S. Cl.
CPC ..... *B22F 1/0059* (2013.01); *B22F 1/0074* (2013.01); *B22F 1/0096* (2013.01); *B22F 3/225* (2013.01); *B22F 7/06* (2013.01); *B22F 3/1007* (2013.01); *B22F 3/24* (2013.01); *B22F 9/026* (2013.01); *B22F 2001/0066* (2013.01); *B22F 2003/247* (2013.01); *B22F 2301/00* (2013.01); *B22F 2301/35* (2013.01)

(58) Field of Classification Search
None
See application file for complete search history.

(56) References Cited

U.S. PATENT DOCUMENTS 5,950,063 A * 9/1999 Hens ..... B22F 1/0059 419/36
6,080,808 A 6/2000 Sterzel
(Continued)

FOREIGN PATENT DOCUMENTS

JP 2001-152205 A 6/2001
JP 2015-048500 A 3/2015
(Continued)

OTHER PUBLICATIONS

K. Ameyama, "Harmonic Structure Design for High Strength and High Ductility Metallic Materials", Sanyo Technical Report vol. 20, No. 1, pp. 1-10 (2013).
(Continued)

*Primary Examiner* — Daniel J. Schleis
(74) *Attorney, Agent, or Firm* — Harness, Dickey & Pierce, P.L.C.

(57) ABSTRACT

A compound for metal powder injection molding includes secondary particles in which first metal particles are bound to one another, and a matrix region including a binder and second metal particles composed of the same constituent material as the first metal particles and having a smaller average particle diameter than the first metal particles. The constituent material of the first metal particles is any of an Fe-based alloy, an Ni-based alloy, and a Co-based alloy.

7 Claims, 3 Drawing Sheets

(51) Int. Cl.

| | |
|---|---|
| ***B22F 7/06*** | (2006.01) |
| *B22F 3/10* | (2006.01) |
| *B22F 3/24* | (2006.01) |
| *B22F 9/02* | (2006.01) |

(56) References Cited

U.S. PATENT DOCUMENTS

| | | | |
|---|---|---|---|
| 2002/0085941 | A1 | 7/2002 | Deevi et al. |
| 2010/0154587 | A1 | 6/2010 | Eason |
| 2016/0193658 | A1 | 7/2016 | Miyasaka |
| 2017/0326641 | A1 | 11/2017 | Lee et al. |

FOREIGN PATENT DOCUMENTS

| | | | |
|---|---|---|---|
| JP | 2015-059236 | A | 3/2015 |
| KR | 2016-0069447 | A | 6/2016 |

OTHER PUBLICATIONS

Extended European Search Report for Application No. EP 18 15 8072 dated Jun. 25, 2018 (8 pages).

* cited by examiner

COMPOUND FOR METAL POWDER INJECTION MOLDING, METAL POWDER MOLDED BODY, METHOD FOR PRODUCING SINTERED BODY, AND SINTERED BODY

BACKGROUND

1. Technical Field

The present invention relates to a compound for metal powder injection molding, a metal powder molded body, a method for producing a sintered body, and a sintered body.

2. Related Art

One known method for molding a metal powder into a molded body is a compression molding method in which a granulated powder including a metal powder and an organic binder is filled in a given molding die and then compressed to obtain a molded body in a given shape. The obtained molded body is subjected to a degreasing treatment of removing the organic binder and a firing treatment of sintering the metal powder, thereby forming a metal sintered body. Such a technique is known as a powder metallurgy technique and is capable of producing a large amount of metal sintered bodies in complicated shapes matching the shapes of the molding dies, and therefore has recently been widely adopted in many industrial fields.

For example, JP-A-2001-152205 discloses a metal powder injection molding method in which a molding material obtained by mixing a metal powder and a binder is injected into a die to mold a molded body. Then, the molded body is heated to remove the binder, and thereafter, the molded body is sintered. JP-A-2001-152205 further discloses that the mixing ratio when a compound is prepared by mixing the metal powder and the binder is 60:40.

Recently, a metal sintered body is required to not only have the high strength characteristics of a metal material, but also to have properties such as high ductility and high toughness. That is, a metal sintered body achieving both high strength and high ductility which generally tend to contradict each other has now been demanded.

Conventional metal sintered bodies do not sufficiently meet this market demand.

SUMMARY

An advantage of some aspects of the invention is to provide a sintered body which achieves both high mechanical strength and high ductility, and also to provide a method for producing a sintered body, a compound for metal powder injection molding, and a metal powder molded body, each capable of producing such a sintered body.

The advantage can be achieved by the following exemplary configurations.

A compound for metal powder injection molding according to an aspect of the invention includes secondary particles in which first metal particles are bound to one another, and a matrix region including a binder and second metal particles composed of the same constituent material as the first metal particles and having a smaller average particle diameter than the first metal particles.

According to this configuration, a compound for metal powder injection molding capable of producing a sintered body which achieves both high mechanical strength and high ductility is obtained.

In the compound for metal powder injection molding according to the aspect of the invention, it is preferred that the constituent material of the first metal particles is any of an Fe-based alloy, an Ni-based alloy, and a Co-based alloy.

According to this configuration, a sintered body having high mechanical strength can be realized.

In the compound for metal powder injection molding according to the aspect of the invention, it is preferred that in the secondary particles, the first metal particles are bound to one another through the binder.

According to this configuration, the first metal particles are bound to one another by utilizing the adhesiveness of the binder, and therefore, secondary particles which are less likely to collapse are obtained regardless of the constituent material of the first metal particles or the like.

In the compound for metal powder injection molding according to the aspect of the invention, it is preferred that in the secondary particles, the first metal particles are adhered to one another.

According to this configuration, it is possible to reduce the amount of the binder to be used, or it is possible to not use the binder, and therefore, the shrinkage ratio of the molded body obtained by injection molding of the compound can be further reduced.

In the compound for metal powder injection molding according to the aspect of the invention, it is preferred that the secondary particles are dispersed in the matrix region.

According to this configuration, a homogeneous compound is obtained. Such a compound enables the production of a molded body which is homogeneous and is less deformed, and thus, a sintered body having high dimensional accuracy and also having high mechanical strength can be realized in the end.

A metal powder molded body according to an aspect of the invention includes secondary particles in which first metal particles are bound to one another, and a matrix region including a binder and second metal particles composed of the same constituent material as the first metal particles and having a smaller average particle diameter than the first metal particles.

According to this configuration, a metal powder molded body capable of producing a sintered body which achieves both high mechanical strength and high ductility is obtained.

A method for producing a sintered body according to an aspect of the invention includes injecting the compound for metal powder injection molding according to the aspect of the invention into a molding die thereby obtaining a molded body, and firing the molded body thereby obtaining a sintered body.

According to this configuration, a sintered body which achieves both high mechanical strength and high ductility can be produced.

A sintered body according to an aspect of the invention includes a first portion including a sintered material of first metal particles, and a second portion encasing the first portion, including a sintered material of second metal particles composed of the same constituent material as the first portion, and having a smaller average crystal grain diameter than the first portion.

According to this configuration, a sintered body which achieves both high mechanical strength and high ductility is obtained.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Hereinafter, the compound for metal powder injection molding, the metal powder molded body, the method for producing a sintered body, and the sintered body according to the invention will be described in detail by way of preferred embodiments with reference to the accompanying drawings.

Compound for Metal Powder Injection Molding

First, an embodiment of the compound for metal powder injection molding according to the invention will be described.

The compound for metal powder injection molding (hereinafter, also simply referred to as "compound") according to this embodiment is a molding material to be subjected to a metal powder injection molding method, and includes a metal powder and a binder.

Figure 1:
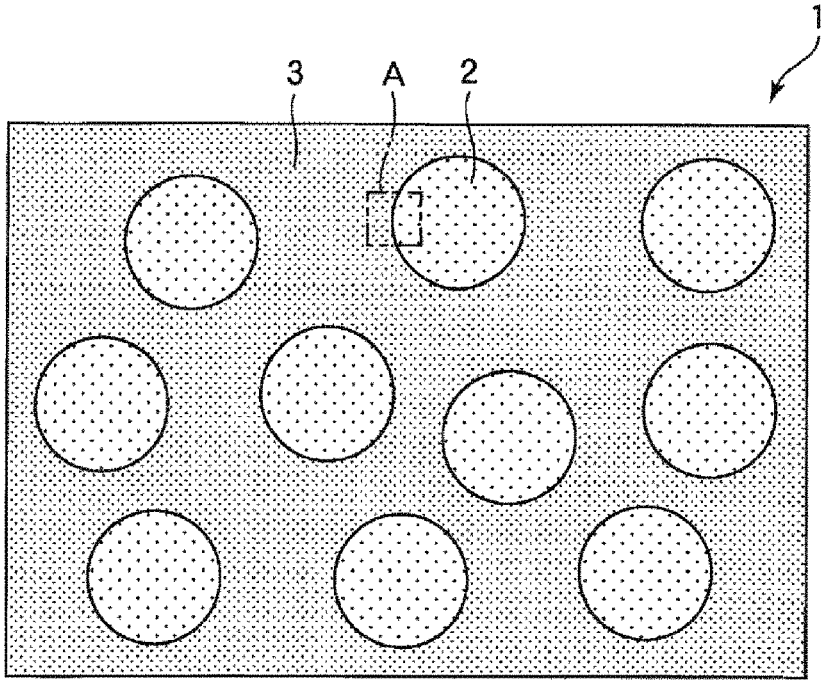
FIG. 1 is a cross-sectional view showing an embodiment of a compound for metal powder injection molding according to the invention.
Figure 2:
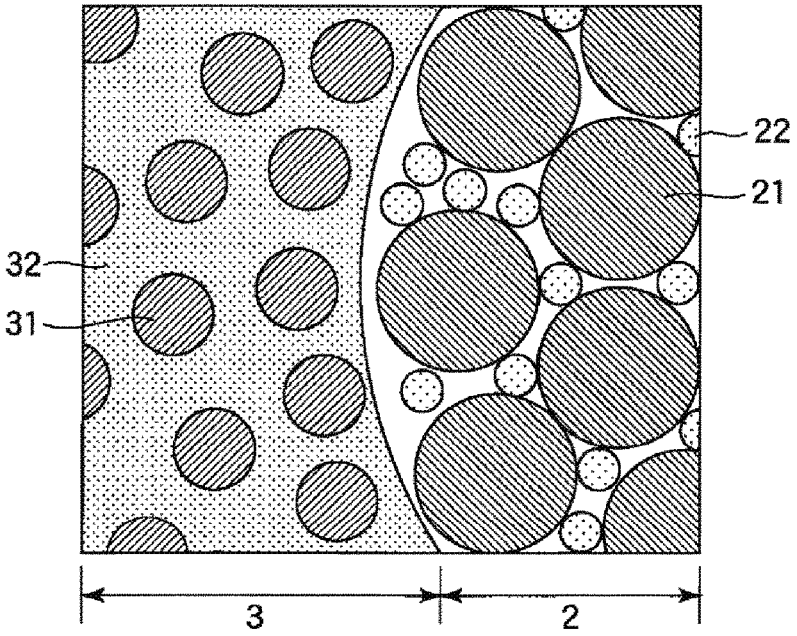
FIG. 2 is an enlarged view of portion A of FIG. 1.

FIG. 1 is a cross-sectional view showing an embodiment of the compound for metal powder injection molding according to the invention, and FIG. 2 is an enlarged view of portion A of FIG. 1.

A compound 1 shown in FIGS. 1 and 2 includes secondary particles 2 in which first metal particles 21 are bound to one another, and a matrix region 3 including a binder 32 and second metal particles 31 composed of the same constituent material as the first metal particles 21 and having a smaller average particle diameter than the first metal particles 21.

Further, in the secondary particle 2 shown in FIG. 2, the first metal particles 21 are bound to one another through a binder 22.

The secondary particle 2 refers to a particle obtained by binding together a plurality of first metal particles 21 which are primary particles. The method for binding the first metal particles 21 is not particularly limited, and the first metal particles 21 may be bound to one another through an intervening material (for example, a coupling agent or the like) other than the binder 22.

On the other hand, in the matrix region 3 shown in FIG. 2, a plurality of second metal particles 31 are dispersed in the binder 32. In this disclosure, a region distributed around the secondary particles 2 is referred to as "matrix region 3".

In the compound 1 including such secondary particles 2 and the matrix region 3, an aggregate of the first metal particles 21 is surrounded by the second metal particles 31 having a smaller average particle diameter than the first metal particles 21. The compound 1 in such a form is injectable into a molding die to form a molded body, and further, the molded body is able to be fired to form a sintered body. As described later, such a sintered body takes a form in which a region having a relatively large crystal grain diameter is surrounded by a region having a relatively small crystal grain diameter. Due to this, the sintered body achieves both high mechanical strength and high ductility.

Further, since the secondary particles 2 in the granular form are present inside the matrix region 3, the shape retainability of the compound 1 is easily maintained. Due to this, for example, even if the content of the binder 32 in the matrix region 3 is reduced, the deformation of the molded body formed by injection molding of the compound 1 is suppressed, and therefore, a sintered body having high dimensional accuracy is obtained in the end.

The existence ratio of the secondary particles 2 in the compound 1 is not particularly limited, but is preferably 1% or more and 99% or less, more preferably 10% or more and 97% or less, further more preferably 30% or more and 96% or less, and particularly preferably 60% or more and 95% or less. According to this, the balance between the secondary particles 2 and the matrix region 3 is further optimized, and therefore, both high mechanical strength and high ductility can be achieved at a higher level in the sintered body.

The existence ratio of the secondary particles 2 can be determined by calculating the ratio of an area occupied by the secondary particles 2 in the cross section of the compound 1.

Further, the secondary particles 2 are preferably dispersed in the matrix region 3. According to this, a homogeneous compound 1 is obtained. Such a compound 1 enables the production of a molded body which is homogeneous and is less deformed, and thus, a sintered body having high dimensional accuracy and also having high mechanical strength can be realized in the end.

Secondary Particle

Each secondary particle 2 shown in FIG. 2 includes the plurality of first metal particles 21 and the binder 22.

First Metal Particle

The constituent material of the first metal particle 21 is not particularly limited, however, examples thereof include metal simple substances such as Mg, Al, Ti, V, Cr, Mn, Fe, Co, Ni, Cu, Zn, Y, Zr, Nb, Mo, Pd, Ag, In, Sn, Ta, and W, and alloys and intermetallic compounds containing at least one metal selected from these metals.

Further, in the secondary particle 2, other metal particles constituted by a material different from that of the first metal particles 21 or ceramic particles may be included. The additional amount of such other metal particles or ceramic particles is preferably 50 vol % or less, more preferably 30 vol % or less, and further more preferably 10 vol % or less of the first metal particles 21.

Among the above-mentioned alloys, examples of an Fe-system alloy include stainless steel, low-carbon steel, carbon steel, heat-resistant steel, dies steel, high-speed tool steel, alloy steel for machine structural use, and Fe-based alloys such as an Fe—Ni alloy and an Fe—Ni—Co alloy.

Examples of an Ni-system alloy include Ni-based alloys such as an Ni—Cr—Fe-system alloy, an Ni—Cr—Mo-system alloy, and an Ni—Fe-system alloy, and specific examples thereof include Ni-32Mo-15Cr-3Si, Ni-16Mo-16Cr-4W-5Fe, Ni-21Cr-9Mo-4Nb, Ni-20Cr-2Ti-1Al, and Ni-19Cr-12Co-6Mo-1W-3Ti-2Al.

Examples of a Co-system alloy include Co-based alloys such as a Co—Cr-system alloy, a Co—Cr—Mo-system alloy, and a Co—Al—W-system alloy.

Examples of a Ti-system alloy include alloys of Ti and a metal element such as Al, V, Nb, Zr, Ta, or Mo, and specific examples thereof include Ti-6Al-4V and Ti-6Al-7Nb.

An example of an Al-system alloy include duralumin.

Among these, the constituent material of the first metal particle 21 is preferably any of an Fe-based alloy, an Ni-based alloy, and a Co-based alloy. Such a constituent material can realize a sintered body having high mechanical strength, and therefore is useful as a constituent material of the first metal particle 21.

Examples of a ceramic material constituting the ceramic particle include oxide-based ceramic materials such as alumina, magnesia, beryllia, zirconia, yttria, forsterite, steatite, wollastonite, mullite, cordierite, ferrite, sialon, and cerium oxide, and non-oxide-based ceramic materials such as silicon nitride, aluminum nitride, boron nitride, titanium nitride, silicon carbide, boron carbide, titanium carbide, and tungsten carbide.

The average particle diameter of the first metal particles 21 is preferably 1 μm or more and 30 μm or less, more preferably 3 μm or more and 25 μm or less, further more preferably 5 μm or more and 20 μm or less. The first metal particles 21 having such a particle diameter facilitate the formation of the secondary particles 2, and therefore contribute to the realization of stable secondary particles 2. Further, when the compound 1 is fired, in the sintered material of the secondary particles 2, crystals having a relatively large grain diameter are easily formed, and therefore, the first metal particles 21 contribute to the improvement of the ductility of the sintered body.

When the average particle diameter of the first metal particles 21 is less than the above lower limit, depending on the content of the binder 22 or the like, there is a fear that the secondary particles 2 are likely to collapse, or the ductility of the sintered body obtained by firing the compound 1 cannot be sufficiently increased. On the other hand, when the average particle diameter of the first metal particles 21 exceeds the above upper limit, depending on the content of the binder 22 or the like, there is a fear that the secondary particles 2 in the granular form are hardly formed, or gaps are easily formed in the sintered material of the secondary particles 2, and therefore, it becomes difficult to sufficiently increase the mechanical strength.

The particle diameter of the first metal particle 21 is obtained by assuming a true circle having the same area as that of the first metal particle 21 in the cross section of the compound 1, and determining the particle diameter as the diameter of the true circle (circle equivalent diameter). Further, the average particle diameter is the average of circle equivalent diameters when the circle equivalent diameters of arbitrarily selected 10 or more first metal particles 21 are determined.

Further, with respect to the first metal particles 21, when the particle diameter at which the cumulative frequency from the small diameter side in a mass-based particle size distribution obtained by laser diffractometry is 10% is represented by D10, the particle diameter at which the cumulative frequency is 50% is represented by D50, and the particle diameter at which the cumulative frequency is 90% is represented by D90, the value of (D90−D10)/D50 is preferably 0.5 or more and 5 or less, more preferably 1.0 or more and 3.5 or less. The first metal particles 21 that satisfy such conditions contribute to the realization of more stable secondary particles 2, and also can achieve both mechanical strength and ductility of the finally obtained sintered body.

Such first metal particles 21 may be produced by any method, however, particles produced by, for example, an atomization method (such as a water atomization method, a gas atomization method, or a spinning water atomization method), a reducing method, a carbonyl method, a pulverization method, or the like can be used.

Among these, as the first metal particles 21, particles produced by an atomization method are preferably used. By using the atomization method, a metal powder having a small variation in particle diameter and therefore having a uniform particle diameter can be obtained. Therefore, the use of such first metal particles 21 contributes to the realization of stable secondary particles 2 and also the realization of a sintered body capable of achieving both high mechanical strength and high ductility.

The content of the first metal particles 21 in the secondary particles 2 is not particularly limited, but is preferably 60 vol % or more and 99 vol % or less, more preferably 70 vol % or more and 97 vol % or less, further more preferably 80 vol % or more and 95 vol % or less. By setting the content of the first metal particles 21 within the above range, the first metal particles 21 contribute to the realization of stable secondary particles 2, and also, a shortage of the amount of the binder 22 does not occur, and therefore, the secondary particles 2 become less likely to collapse.

Binder

The binder 22 binds the first metal particles 21 to one another (also binds the other metal particles and the ceramic particles in the same manner) and facilitates the formation of the secondary particles 2. This binder 22 is almost entirely removed in the firing step.

That is, the secondary particles 2 are obtained by binding the first metal particles 21 through the binder 22. In such secondary particles 2, the first metal particles 21 are bound to one another by utilizing the adhesiveness of the binder 22, and therefore, the secondary particles 2 which are still less likely to collapse are obtained regardless of the constituent material of the first metal particles 21 or the like.

The binder 22 is not particularly limited as long as it has a binding property, however, examples thereof include various resins such as polyolefins such as polyethylene, polypropylene, and ethylene-vinyl acetate copolymers, acrylic resins such as polymethyl methacrylate and polybutyl methacrylate, styrenic resins such as polystyrene, polyesters such as polyvinyl chloride, polyvinylidene chloride, polyamide, polyethylene terephthalate, and polybutylene terephthalate, polyether, polyvinyl alcohol, polyvinylpyrrolidone, and copolymers thereof, waxes, alcohols, higher fatty acids, fatty acid metals, higher fatty acid esters, higher fatty acid amides, nonionic surfactants, and silicone-based lubricants. Among these, one type or a mixture of two or more types is used.

Among these, examples of the waxes include natural waxes such as vegetable waxes such as candelilla wax, carnauba wax, rice wax, Japan wax, and jojoba wax, animal waxes such as beeswax, lanolin, and spermaceti wax, mineral waxes such as montan wax, ozokerite, and ceresin, and petroleum-based waxes such as paraffin wax, microcrystalline wax, and petrolatum, and synthetic waxes such as synthetic hydrocarbons such as polyethylene wax, modified waxes such as montan wax derivatives, paraffin wax derivatives, and microcrystalline wax derivatives, hydrogenated waxes such as hydrogenated castor oil and hydrogenated castor oil derivatives, fatty acids such as 12-hydroxystearic acid, acid amides such as stearic acid amide, and esters such as phthalic anhydride imide.

Examples of the alcohols include polyhydric alcohols, polyglycols, and polyglycerols, and particularly, cetyl alcohol, stearyl alcohol, oleyl alcohol, mannitol, or the like is preferably used.

Examples of the higher fatty acids include stearic acid, oleic acid, and linoleic acid, and particularly, a saturated fatty acid such as lauric acid, myristic acid, palmitic acid, stearic acid, or arachidic acid is preferably used.

Examples of the fatty acid metals include compounds of a higher fatty acid such as lauric acid, stearic acid, succinic acid, stearyllactic acid, lactic acid, phthalic acid, benzoic acid, hydroxystearic acid, ricinoleic acid, naphthenic acid, oleic acid, palmitic acid, or erucic acid with a metal such as Li, Na, Mg, Ca, Sr, Ba, Zn, Cd, Al, Sn, Pb, or Cd, and particularly, magnesium stearate, calcium stearate, sodium stearate, zinc stearate, calcium oleate, zinc oleate, magnesium oleate, or the like is preferably used.

Examples of the nonionic surfactants include Electrostripper TS-2 and Electrostripper TS-3 (both are manufactured by Kao Corporation).

Examples of the silicone-based lubricants include dimethylpolysiloxane and modified dimethylpolysiloxane, carboxyl-modified silicone, α-methylstyrene-modified silicone, α-olefin-modified silicone, polyether-modified silicone, fluorine-modified silicone, hydrophilic special modified silicone, olefin/polyether-modified silicone, epoxy-modified silicone, amino-modified silicone, amide-modified silicone, and alcohol-modified silicone.

As the binder 22, particularly, a binder including polyvinyl alcohol or polyvinylpyrrolidone is preferred. Such a binder component has a high binding property, and therefore, even if the binder is used in a relatively small amount, the secondary particles 2 can be efficiently formed. Further, the binder component also has high thermal decomposability, and therefore can be reliably decomposed and removed in a short time during degreasing and firing.

Further, the content of the binder 22 in the secondary particles 2 is not particularly limited, but is preferably 1 vol % or more and 40 vol % or less, more preferably 3 vol % or more and 30 vol % or less, further more preferably 5 vol % or more and 20 vol % or less. By setting the content of the binder 22 within the above range, the binder 22 contributes to the realization of stable secondary particles 2, and also, the amount of the binder 22 is not too much, and therefore, such a range contributes to the enhancement of the mechanical strength by increasing the density of the sintered body.

When the content of the binder 22 is lower than the above lower limit, depending on the particle diameter of the first metal particles 21, or the like, there is a fear that the secondary particles 2 are likely to collapse. On the other hand, when the content of the binder 22 exceeds the above upper limit, the amount of the binder 22 is too much, and therefore, there is a fear that it becomes difficult to increase the density of the sintered body, or the shrinkage ratio is increased and thus, the dimensional accuracy of the sintered body is likely to be deteriorated.

The content of the binder in the secondary particle 2 can be obtained by, for example, observing the cross section of the secondary particle 2 and performing calculation from the area ratio of the binder 22 in the cross section.

Further, a component other than the first metal particles 21 and the binder 22 may be added to the secondary particles 2, for example, any of various additives such as a solvent (dispersion medium), an anti-rust agent, an antioxidant, a dispersant, and an anti-foaming agent. The additional amount of such an additive is preferably about 5 mass % or less, more preferably about 3 mass % or less of the secondary particles 2.

The binder 22 may be added as desired, and for example, in the case where the first metal particles 21 are voluntarily bound to one another by adhesion or the like, the addition of the binder 22 can be omitted. That is, the first metal particles 21 may be adhered to one another in the secondary particle 2. According to this, it becomes possible to reduce the amount of the binder 22 to be used, or it is possible to no longer use the binder 22, and therefore, the shrinkage ratio of the molded body obtained by injection molding of the compound 1 can be further reduced.

The adhesion herein refers to a state where the surfaces of the first metal particles 21 closely contact one another so as to be integrated with one another while maintaining the granular shapes of the respective first metal particles 21. This close contact can be either direct contact with one another with no binder 22 therebetween, indirect contact one another with some slight amount of binder 22 therebetween, or a combination of both direct and indirect contact.

Further, in the secondary particles 2, the first metal particles 21 which are adhered to one another and the first metal particles 21 which are not adhered to one another may coexist together.

Matrix Region

The matrix region 3 shown in FIG. 2 includes the binder 32 and the second metal particles 31 composed of the same constituent material as the first metal particles 21 and having a smaller average particle diameter than the first metal particles 21.

The secondary particle 2 has a granular shape as described above, however, from the viewpoint of aspect ratio, the average of the major axis/the minor axis is preferably 1 or more and 3 or less, more preferably 1 or more and 2.5 or less, further more preferably 1 or more and 2 or less. The secondary particle 2 having such an aspect ratio has a shape with high isotropy, and therefore, collapse or the like is less likely to occur. Due to this, the secondary particles 2 can play the role of the skeleton of the compound 1, and can further enhance the shape retainability of a molded body obtained by molding the compound 1.

The aspect ratio of the secondary particle 2 is calculated by, for example, acquiring an observation image of the cross section of the compound 1 by an electron microscope, and determining the maximum length (major axis) of the secondary particle 2 and the maximum length (minor axis) in the direction orthogonal to the major axis on the image. In the calculation of the average, 10 or more pieces of data are used. Further, according to need, an elemental mapping image may be used so as to facilitate the recognition of the contour of the secondary particle 2.

The average diameter of the secondary particles 2 is preferably in the range of about 1.5 times or more and 100 times or less, more preferably about 2 times or more and 80 times or less, further more preferably about 3 times or more and 50 times or less of the average particle diameter of the first metal particles 21. According to this, the balance between the particle diameter of the secondary particles 2 and the particle diameter of the first metal particles 21 is optimized. As a result, the secondary particles 2 themselves are still less likely to collapse, and therefore, the shape retainability of a molded body obtained by molding the compound 1 can be further enhanced.

The average diameter of the secondary particles 2 is obtained by, for example, acquiring an observation image of the cross section of the compound 1 by an electron microscope, and determining the diameter as the diameter of a true circle (circle equivalent diameter) having the same area as that of the secondary particle 2 on the image. In the calculation of the average, 10 or more pieces of data are used. Further, if desired, an elemental mapping image may be used so as to facilitate the recognition of the contour of the secondary particle 2.

Second Metal Particle

The constituent material of the second metal particles 31 is the same material as the first metal particles 21. The same material herein means that, for example, the alloy composition falls within the range of the composition of each alloy specified by various standards of the Japanese Industrial Standards or the like. Specifically, for example, when the constituent material of the first metal particles 21 is SUS316L, the alloy composition of the constituent material of the second metal particles 31 may fall within the range of the alloy composition of SUS316L specified by various standards of the Japanese Industrial Standards or the like. Further, in the case of a nonstandard alloy, when the deviation of the content of the constituent element is 3 mass % or less, the constituent materials can be regarded as the same material.

In the matrix region 3, other metal particles constituted by a material different from that of the second metal particles 31 or ceramic particles may be included. The additional amount of such other metal particles or ceramic particles is preferably 50 vol % or less, more preferably 30 vol % or less, and further more preferably 10 vol % or less of the second metal particles 31.

The average particle diameter of the second metal particles 31 is set smaller than the average particle diameter of the first metal particles 21.

Specifically, the average particle diameter of the second metal particles 31 is preferably 95% or less, more preferably 5% or more and 80% or less, further more preferably 10% or more and 60% or less of the average particle diameter of the first metal particles 21. According to this, in the compound 1, the periphery of the secondary particle 2 which is an aggregate of the first metal particles 21 is surrounded by the second metal particles 31 having a moderately smaller average particle diameter than the first metal particles 21. When a molded body obtained by injection molding of the compound 1 in such a form is fired, a sintered body having a portion derived from the secondary particles 2 and a portion derived from the matrix region 3 together is formed. Such a sintered body achieves both high mechanical strength and high ductility as described below.

When the average particle diameter of the second metal particles 31 is lower than the above lower limit, although it depends on the particle diameter of the first metal particle 21, the second metal particles 31 are likely to aggregate, and therefore, it becomes difficult to uniformly disperse the second metal particles 31 in the matrix region 3. Due to this, a homogeneous sintered body is hardly formed, and thus, the mechanical strength or the ductility may be decreased. On the other hand, when the average particle diameter of the second metal particles 31 exceeds the above upper limit, the average particle diameter of the first metal particles 21 and the average particle diameter of the second metal particles 31 come closer to each other, and therefore, the effect of surrounding the sintered material of the metal particles having a large average particle diameter with the sintered material of the metal particles having a small average particle diameter, that is, the effect of achieving both high strength and high ductility may be reduced.

The particle diameter of the second metal particle 31 is obtained by assuming a true circle having the same area as that of the second metal particle 31 in the cross section of the compound 1, and determining the particle diameter as the diameter of the true circle (circle equivalent diameter). Further, the average particle diameter is the average of circle equivalent diameters when the circle equivalent diameters of arbitrarily selected 10 or more second metal particles 31 are determined.

Further, with respect to the second metal particles 31, when the particle diameter at which the cumulative frequency from the small diameter side in a mass-based particle size distribution obtained by laser diffractometry is 10% is represented by D10, the particle diameter at which the cumulative frequency is 50% is represented by D50, and the particle diameter at which the cumulative frequency is 90% is represented by D90, the value of (D90−D10)/D50 is preferably 0.5 or more and 5 or less, more preferably 1.0 or more and 3.5 or less. The second metal particles 31 that satisfy such conditions can achieve both mechanical strength and ductility of the finally obtained sintered body.

Such second metal particles 31 may be produced by any method, however, particles produced by, for example, an atomization method (such as a water atomization method, a gas atomization method, or a spinning water atomization method), a reducing method, a carbonyl method, a pulverization method, or the like can be used.

Among these, as the second metal particles 31, particles produced by an atomization method are preferably used. By using the atomization method, a metal powder having a small variation in particle diameter and therefore having a uniform particle diameter can be obtained. Therefore, the use of such second metal particles 31 contributes to the realization of a sintered body capable of achieving both high mechanical strength and high ductility.

The content of the second metal particles 31 in the matrix region 3 is not particularly limited, but is preferably 50 vol % or more and 90 vol % or less, more preferably 55 vol % or more and 85 vol % or less, further more preferably 60 vol % or more and 80 vol % or less. By setting the content of the second metal particles 31 within the above range, the compound 1 in which poor filling and an excessive shrinkage ratio are suppressed is obtained.

Binder

The binder 32 binds the second metal particles 31 to one another (also binds the other metal particles and the ceramic particles in the same manner) and makes it easy to maintain the shape of the matrix region 3. This binder 32 is almost entirely removed in the firing step.

The binder 32 is not particularly limited as long as it has a binding property, and may be the same as or different from the binder 22, however, examples thereof include various resins such as polyolefins such as polyethylene, polypropylene, and ethylene-vinyl acetate copolymers, acrylic resins such as polymethyl methacrylate and polybutyl methacrylate, styrenic resins such as polystyrene, polyesters such as polyvinyl chloride, polyvinylidene chloride, polyamide, polyethylene terephthalate, and polybutylene terephthalate, polyether, polyvinyl alcohol, polyvinylpyrrolidone, and copolymers thereof, waxes, alcohols, higher fatty acids, fatty acid metals, higher fatty acid esters, higher fatty acid amides, nonionic surfactants, and silicone-based lubricants. Among these, one type or a mixture of two or more types is used.

As the binder 32, particularly, a material containing a hydrocarbon-based polymer and a wax is preferably used.

Among these, the hydrocarbon-based polymer refers to a material which is a polymeric compound mainly constituted by carbon atoms and hydrogen atoms and has a polymerization degree of about 50 or more (preferably 100 or more). The hydrocarbon-based polymer has a higher thermal decomposition temperature than the wax.

On the other hand, the wax refers to a material which is a saturated chain polymeric compound mainly constituted by carbon atoms and hydrogen atoms and has a polymerization degree of about less than 50 (preferably 30 or less).

By using such a hydrocarbon-based polymer and a wax in combination, the initial shape retainability of the molded body is maintained by the wax, and on the other hand, the behavior such that the hydrocarbon-based polymer is gradually decomposed throughout a relatively wide temperature range is easily established. Since the shape of the molded body is easily maintained throughout all the steps, a sintered body having a particularly high dimensional accuracy is obtained in the end.

Hydrocarbon-Based Polymer

Examples of the hydrocarbon-based polymer include saturated hydrocarbon-based resins and unsaturated hydrocarbon-based resins. Further, the hydrocarbon-based polymers are also classified into chain hydrocarbon-based resins, cyclic hydrocarbon resins, and the like according to the binding form of the carbon atoms.

Examples of such a hydrocarbon-based polymer include polyolefins such as polyethylene, polypropylene, polybutylene, and polypentene, polyolefin-based copolymers such as a polyethylene-polypropylene copolymer and a polyethylene-polybutylene copolymer, and polystyrene, and the binder is constituted by one type or two or more types among these.

Among these, the binder 32 preferably contains at least one of a polyolefin resin and a polystyrene resin. These hydrocarbon-based polymers have a relatively large binding ability and also have relatively high thermal decomposability, and therefore, the shape of the molded body is easily maintained during degreasing. Therefore, these hydrocarbon-based polymers contribute to rapid degreasing and the improvement of sinterability thereby. As a result, a sintered body having high dimensional accuracy is obtained.

The weight average molecular weight of the hydrocarbon-based polymer is preferably 10,000 or more and 100,000 or less, more preferably 20,000 or more and 80,000 or less. By setting the weight average molecular weight of the hydrocarbon-based polymer within the above range, while imparting sufficient shape retainability to the molded body, degreasing can be easily and reliably performed. When the weight average molecular weight of the hydrocarbon-based polymer is less than the above lower limit, there is a fear that sufficient shape retainability cannot be imparted to the molded body, and when the weight average molecular weight of the hydrocarbon-based polymer exceeds the above upper limit, the decomposability of the hydrocarbon-based polymer when degreasing the molded body may be deteriorated.

The content of the hydrocarbon-based polymer in the binder 32 is preferably 1 mass % or more and 98 mass % or less, more preferably 15 mass % or more and 50 mass % or less, further more preferably 20 mass % or more and 45 mass % or less. By setting the content of the hydrocarbon-based polymer within the above range, the property of the hydrocarbon-based polymer can be sufficiently exhibited in the binder 32. When the content of the hydrocarbon-based polymer is lower than the above lower limit, there is a fear that sufficient shape retainability cannot be imparted to the molded body. On the other hand, when the content of the hydrocarbon-based polymer exceeds the above upper limit, the amount of the component other than the hydrocarbon-based polymer such as the wax is relatively too small, and therefore, it may take a long time to degrease the molded body, or a defect such as a crack may occur in the molded body which is caused by the decomposition of a large amount of the hydrocarbon-based polymer at once.

As the hydrocarbon-based polymer, it is preferred to use a hydrocarbon-based polymer having a thermal decomposition temperature of 300° C. or higher and 550° C. or lower, and it is more preferred to use a hydrocarbon-based polymer having a thermal decomposition temperature of 400° C. or higher and 500° C. or lower. Such a hydrocarbon-based polymer corresponds to a binder component which thermally decomposed in a relatively high temperature range, and therefore contributes to the shape retention of the molded body when degreasing the molded body until degreasing is completed. As a result, a sintered body having high dimensional accuracy can be obtained in the end.

Further, as the hydrocarbon-based polymer, it is preferred to use a hydrocarbon-based polymer having a melting point of 100° C. or higher and 400° C. or lower, and it is more preferred to use a hydrocarbon-based polymer having a melting point of 200° C. or higher and 300° C. or lower.

The thermal decomposition temperature and the melting point are measured using a simultaneous thermogravimetric and differential thermal analyzer (TG/DTA) or the like.

Wax

The wax is defined as a material which contains a relatively large amount of a crystalline polymer and has a smaller weight average molecular weight than the resin by preferably 5000 or more, more preferably 10000 or more. Therefore, the wax is melted and decomposed in a lower temperature range than the hydrocarbon-based polymer and forms a flow channel when it is released to the outside of the molded body at the time of degreasing the molded body. Thereafter, when the molded body is heated to a higher temperature, the decomposition of the hydrocarbon-based polymer starts this time, and the decomposition product is released to the outside of the molded body through the flow channel. By removing the hydrocarbon-based polymer through the flow channel in this manner, the decomposition product of the hydrocarbon-based polymer is efficiently released to the outside, and therefore, the breakage of the molded body can be prevented. As a result, the shape of the molded body can be more reliably maintained also in the degreasing process, and thus, a sintered body having high dimensional accuracy is obtained in the end.

Examples of the wax include natural waxes and synthetic waxes.

Among these, examples of the natural waxes include vegetable waxes such as candelilla wax, carnauba wax, rice wax, Japan wax, and jojoba wax, animal waxes such as beeswax, lanolin, and spermaceti wax, mineral waxes such as montan wax, ozokerite, and ceresin, and petroleum-based waxes such as paraffin wax, microcrystalline wax, and petrolatum. Among these, one type can be used or two or more types can be used in combination.

Examples of the synthetic waxes include synthetic hydrocarbons such as polyethylene wax, modified waxes such as montan wax derivatives, paraffin wax derivatives, and microcrystalline wax derivatives, hydrogenated waxes such as hydrogenated castor oil and hydrogenated castor oil derivatives, fatty acids such as 12-hydroxystearic acid, acid amides such as stearic acid amide, and esters such as phthalic anhydride imide. Among these, one type can be used or two or more types can be used in combination.

In this embodiment, particularly, it is preferred to use a petroleum-based wax or a modified wax thereof, it is more preferred to use paraffin wax, microcrystalline wax, or a derivative thereof, and it is further more preferred to use paraffin wax. These waxes have excellent compatibility with the hydrocarbon-based polymer, and therefore, a homogeneous binder composition and a homogeneous compound can be prepared. Due to this, this contributes to the production of a sintered body which is homogeneous and has an excellent mechanical property and high dimensional accuracy in the end.

The weight average molecular weight of the wax is preferably 100 or more and 2000 or less, more preferably 200 or more and 1000 or less. By setting the weight average molecular weight of the wax within the above range, the wax can be more reliably melted in a lower temperature range than the hydrocarbon-based polymer when degreasing the compound 1, and a flow channel for releasing the decomposition product of the hydrocarbon-based polymer can be more reliably formed in the molded body. When the weight average molecular weight of the wax is less than the above lower limit, the shape retainability of the molded body may be deteriorated. On the other hand, when the weight average molecular weight of the wax exceeds the above upper limit, the temperature range in which the wax is melted and the temperature range in which the hydrocarbon-based polymer is melted come closer to each other, and therefore, a crack or the like may occur in the molded body.

The content of the wax in the binder 32 is preferably 1 mass % or more and 70 mass % or less, more preferably 10 mass % or more and 50 mass % or less, further more preferably 15 mass % or more and 40 mass % or less. By setting the content of the wax within the above range, the property of the wax can be sufficiently exhibited in the binder 32. When the content of the wax is lower than the above lower limit, there is a fear that a sufficient amount of the flow channel cannot be formed in the molded body, and therefore, a crack or the like may occur when degreasing the molded body. On the other hand, when the content of the wax exceeds the above upper limit, the ratio of the hydrocarbon-based polymer is relatively decreased, and therefore, the shape retainability of the molded body may be deteriorated.

As the wax, it is preferred to use a wax having a melting point of 30° C. or higher and 200° C. or lower, and it is more preferred to use a wax having a melting point of 50° C. or higher and 150° C. or lower.

The thermal decomposition temperature and the melting point are measured using a simultaneous thermogravimetric and differential thermal analyzer (TG/DTA) or the like.

Hereinabove, the hydrocarbon-based polymer and the wax have been described, however, from another viewpoint, the binder 32 preferably includes both of a crystalline resin such as a wax and an amorphous resin such as polystyrene. According to this, the initial shape retainability of the molded body is maintained by the crystalline resin, and on the other hand, the amorphous resin is gradually decomposed throughout a relatively wide temperature range and released to the outside. As a result, a sintered body having a particularly high dimensional accuracy is obtained in the end.

The mixing ratio of the crystalline resin to the amorphous resin is not particularly limited, however, it is preferred to set the amount of the amorphous resin larger than the amount of the crystallin resin. Specifically, the amount of the amorphous resin is set to preferably 101 parts by mass or more and 300 parts by mass or less, more preferably 110 parts by mass or more and 250 parts by mass or less with respect to 100 parts by mass of the crystallin resin. According to this, the shape retainability of the molded body can be further enhanced, and the dimensional accuracy can be further enhanced in the end. That is, when the mixing ratio of the amorphous resin is lower than the above lower limit, depending on the particle diameter of the metal powder, the component of the binder 32, or the like, the shape retainability of the molded body when the temperature changes may be slightly deteriorated. On the other hand, when the mixing ratio of the amorphous resin exceeds the above upper limit, depending on the particle diameter of the metal powder, the component of the binder 32, or the like, the initial shape retainability of the molded body may be slightly deteriorated.

Cyclic Ether Group-Containing Copolymer

To the binder 32, a cyclic ether group-containing copolymer may be added as desired. This cyclic ether group-containing copolymer is a copolymer obtained by copolymerization of a monomer containing a cyclic ether group (cyclic ether group-containing monomer) and a monomer copolymerizable with this cyclic ether group-containing monomer. By adding such a copolymer, a structure derived from the cyclic ether group-containing monomer has excellent adhesion to the metal powder, and by forming the copolymer, the compatibility with the hydrocarbon-based polymer or the wax can be enhanced. That is, such a copolymer contributes to the enhancement of the mutual wettability of the metal powder and the hydrocarbon-based resin and the wax, and further contributes to the enhancement of the mutual dispersibility in the compound 1. As a result, the compound 1 becomes homogeneous, resulting in obtaining a sintered body having an excellent mechanical property and high dimensional accuracy.

Examples of the cyclic ether group include an epoxy group and an oxetanyl group. Such a group is ring-opened by heat applied to the compound 1 and is bound to a hydroxy group on the surface of the metal powder. As a result, the metal powder and the copolymer exhibit high adhesion, and the dispersibility of the second metal particles 31 in the matrix region 3 becomes more favorable. Further, from the viewpoint that the binding to the surface of the metal powder is easy or the like, an epoxy group is particularly preferred among the cyclic ether groups.

Examples of the cyclic ether group-containing monomer include glycidyl esters such as glycidyl acrylate and glycidyl methacrylate, glycidyl ethers such as vinyl glycidyl ether and allyl glycidyl ether, and oxetane esters such as oxetane acrylate and oxetane methacrylate. Among these, one type can be used or two or more types can be used in combination.

Examples of the monomer copolymerizable with such a cyclic ether group-containing monomer include (meth)acrylate ester-based monomers such as methyl (meth)acrylate, ethyl (meth)acrylate, and butyl (meth)acrylate, olefin-based monomers such as ethylene, propylene, isobutylene, and butadiene, and vinyl acetate-based monomers. Among these, one type can be used or two or more types can be used in combination. The expression of "(meth)acrylic acid" represents either acrylic acid or methacrylic acid.

Among these, an ethylene monomer and a vinyl acetate monomer are preferably used. Ethylene and vinyl acetate have particularly excellent compatibility with the hydrocarbon-based polymer and the wax. Therefore, by using both of an ethylene monomer and a vinyl acetate monomer, the resulting polymer is interposed between the metal powder and the hydrocarbon-based polymer or the wax and has a function to particularly enhance the mutual wettability of these components.

As a preferred combination of the cyclic ether group-containing monomer with the monomer copolymerizable with the cyclic ether group-containing monomer as described above, for example, glycidyl (meth)acrylate (GMA) and vinyl acetate (VA), glycidyl (meth)acrylate and ethylene, glycidyl (meth)acrylate, vinyl acetate, and ethylene (E), and glycidyl (meth)acrylate, vinyl acetate, and methyl acrylate (MA) are exemplified.

The content of the cyclic ether group-containing monomer in the cyclic ether group-containing copolymer is not particularly limited, but is preferably about 0.1 mass % or more and 50 mass % or less, more preferably about 1 mass % or more and 30 mass % or less. According to this, adhesion between the cyclic ether group-containing copolymer and the second metal particles 31 is reliably obtained, and therefore, the above-mentioned effect when using the copolymer is more reliably exhibited.

The weight average molecular weight of the cyclic ether group-containing copolymer is preferably 10,000 or more and 400,000 or less, more preferably 30,000 or more and 300,000 or less. By setting the weight average molecular weight of the cyclic ether group-containing copolymer within the above range, while preventing a significant lowering of the thermal decomposability of the cyclic ether group-containing copolymer, the fluidity of the compound 1 and the shape retainability of the molded body can be both achieved.

The sequence of the monomers in the cyclic ether group-containing copolymer is not particularly limited, and any sequence such as random copolymerization, alternating copolymerization, block copolymerization, and graft copolymerization may be adopted.

The content of the cyclic ether group-containing copolymer in the compound 1 is preferably about 10% or more and 100% or less, more preferably about 15% or more and 80% or less, further more preferably about 20% or more and 50% or less of the content of the wax in terms of mass ratio. By setting the content of the cyclic ether group-containing copolymer within the above range, the mutual wettability of the metal powder and the hydrocarbon-based polymer and the wax can be particularly enhanced. As a result, the dispersibility of the second metal particles 31 in the compound 1 can be particularly enhanced.

As the cyclic ether group-containing copolymer, it is preferred to use a cyclic ether group-containing copolymer having a melting point of 30° C. or higher and 150° C. or lower, it is more preferred to use a cyclic ether group-containing copolymer having a melting point of 50° C. or higher and 100° C. or lower.

The binder 32 may include another component. The content of such another component in the binder 32 is preferably, for example, 10 mass % or less.

The content of the binder 32 in the matrix region 3 is not particularly limited, but is set higher than the content of the binder 22 in the secondary particle 2, and is preferably set to about 1.1 times by volume or more and 20 times by volume or less, more preferably set to about 2 times by volume or more and 10 times by volume or less. By setting the content of the binder 32 within the above range, while the fluidity desired for the compound 1 for metal powder injection molding is ensured, the compound 1 in which the content of the binder is reduced by receiving the benefit of the secondary particles 2 is obtained. In such a compound 1, poor filling and also a poor shrinkage ratio are suppressed, and therefore, it contributes to the realization of the sintered body having high dimensional accuracy and high mechanical strength.

When the content of the binder 32 is lower than the above lower limit, depending on the composition of the binder 32 or the like, there is a fear that the fluidity is insufficient. On the other hand, when the content of the binder 32 exceeds the above upper limit, depending on the composition of the binder 32 or the like, there is a fear that the shape retainability of the molded body is deteriorated or the shrinkage ratio is increased, and therefore, the dimensional accuracy of the sintered body is deteriorated.

Further, the content of the binder 32 in the matrix region 3 is not particularly limited, but is preferably 10 vol % or more and 50 vol % or less, more preferably 15 vol % or more and 45 vol % or less, further more preferably 20 vol % or more and 40 vol % or less.

The content of the binder 32 in the matrix region 3 can be obtained by, for example, observing the cross section of the matrix region 3, and determining the content from the area ratio of the binder 32 in the cross section.

Further, to the matrix region 3, a component other than the second metal particles 31 and the binder 32, for example, any of various additives such as a solvent (dispersion medium), an anti-rust agent, an antioxidant, a dispersant, and an anti-foaming agent may be added. The additional amount of such an additive is preferably about 5 mass % or less, more preferably about 3 mass % or less of the matrix region 3.

Method for Producing Compound for Metal Powder Injection Molding

Next, an exemplary method for producing a compound for metal powder injection molding will be described.

[1] First, the first metal particles 21 are granulated by any of various granulation methods.

Examples of the granulation method include a spray drying method, a tumbling granulation method, a fluidized bed granulation method, and a tumbling fluidized bed granulation method.

For example, in a spray drying method, a slurry (suspension) obtained by mixing the first metal particles 21 and the binder 22 is used. Then, by spray drying this slurry, the secondary particles 2 are obtained.

In the slurry, as the solvent (dispersion medium), for example, water, an alcohol, or the like is used.

Further, to the obtained secondary particles 2, a vibration treatment, a crushing treatment, or the like may be applied as desired.

Further, to the obtained secondary particles 2, a heating treatment may be applied as desired. According to this, the hygroscopicity of the binder 22 is slightly decreased, and therefore, the secondary particles 2 hardly absorb moisture, and thus, the occurrence of sintering failure due to moisture absorption is suppressed.

Further, depending on the conditions of the heating treatment, a sintering phenomenon may be partially caused between the first metal particles 21 to adhere the first metal particles 21.

Examples of the heating method include heating in a heating furnace, flame irradiation, laser irradiation, and plasma irradiation.

The heating temperature varies depending on the composition of the first metal particles 21 or the binder 22, or the like, but is preferably about 200° C. or higher and 800° C. or lower, more preferably about 250° C. or higher and 700° C. or lower, further more preferably about 300° C. or higher and 600° C. or lower. By performing heating at such a temperature, while preventing the complete sintering of the first metal particles 21, the first metal particles 21 can be partially sintered, or the volume reduction of the binder 22 can be achieved. As a result, the secondary particles 2 themselves are less likely to collapse, and therefore, the shape thereof is easily maintained also in the compound 1, and the effect brought about by the secondary particles 2 described above is more reliably exhibited.

The heating time is set according to the heating temperature, but is preferably about 5 minutes or more and 300 minutes or less, more preferably about 10 minutes or more and 180 minutes or less, further more preferably about 30 minutes or more and 120 minutes or less as the duration of the heating time. By setting the heating time within such a range, while preventing the complete sintering of the first metal particles 21, the first metal particles 21 can be partially sintered, or the volume reduction of the binder 22 can be achieved.

The heating atmosphere is not particularly limited, however, for example, an oxidizing atmosphere such as air or oxygen, an inert atmosphere such as nitrogen or argon, a reducing atmosphere such as hydrogen, or the like is used. Among these, in consideration of oxidation of the first metal particles 21 or the like, an inert atmosphere or a reducing atmosphere is preferably used, and in consideration of safety, hydrogen embrittlement, or the like, an inert atmosphere is preferably used.

[2] Subsequently, the second metal particles 31 and the binder 32 are kneaded, whereby a kneaded material is obtained.

In the kneading, for example, any of various kneading machines such as a pressure or double-arm kneader-type kneading machine, a roll-type kneading machine, a Banbury (registered trademark) type kneading machine, and a single-screw or twin-screw extruder machine can be used.

The kneading conditions vary depending on various conditions such as the particle diameter of the second metal particles 31 to be used and the mixing ratio of the second metal particles 31 to the binder 32, however, for example, the kneading temperature can be set to 50° C. or higher and 200° C. or lower, and the kneading time can be set to about 15 minutes or more and 210 minutes or less.

Subsequently, to the thus obtained kneaded material, the secondary particles 2 are added, and kneading is performed again. By doing this, the secondary particles 2 are dispersed in the kneaded material. As a result, the compound 1 including the secondary particles 2 and the matrix region 3 is obtained.

The secondary particles 2 may be added simultaneously with the second metal particles 31, and on the contrary, after the secondary particles 2 and the binder 32 are kneaded, the second metal particles 31 may be added thereto.

The above-mentioned production method is an exemplary method, and the compound 1 may be produced by a different method from the above-mentioned production method.

Method for Producing Sintered Body

Next, an exemplary method for producing a sintered body using the compound 1 will be described.

The method for producing a sintered body includes an injection molding step of injection molding the compound 1 into a desired shape, a degreasing step of degreasing the obtained molded body, and a firing step of firing the obtained degreased body.

That is, the method for producing a sintered body includes a step of injecting the compound 1 into a molding die thereby obtaining a molded body, and a step of degreasing the molded body, followed by firing thereby obtaining a sintered body.

According to such a production method, a sintered body having both high mechanical strength and high ductility can be produced.

Hereinafter, the respective steps will be sequentially described.

Molding Step

First, injection molding is performed using the compound 1 as described above. By doing this, a molded body (an embodiment of the metal powder molded body according to the invention) having a desired shape and dimension is produced.

Prior to the molding, the compound 1 may be subjected to a pelletizing treatment as desired. The pelletizing treatment is a treatment of crushing the compound 1 using a crushing device such as a pelletizer (registered trademark). The thus obtained pellets have an average particle diameter of about 1 mm or more and 10 mm or less.

Subsequently, the obtained pellet is placed in an injection molding machine and molded by injection into a molding die. By doing this, a molded body having the shape of the molding die transferred thereto is obtained.

The shape and dimension of the molded body to be produced is determined in anticipation of the amount of shrinkage by degreasing and sintering to be performed thereafter.

The thus obtained molded body may be subjected to post-processing such as machining processing or laser processing as desired.

Further, molding may be performed also using another compound different from the compound 1 (two-color molding), or another member is disposed in advance in the cavity of the molding die and the compound 1 may be injection molded so as to come into contact with the member (insert molding).

Degreasing Step

Subsequently, the obtained molded body is subjected to a degreasing treatment (binder removal treatment). By doing this, the binder 22 and the binder 32 contained in the molded body are removed (degreased), whereby a degreased body is obtained.

This degreasing treatment is not particularly limited, but is performed by performing a heat treatment in a non-oxidizing atmosphere, for example, under vacuum or a reduced pressure (for example, $1\times10^{-6}$ Torr or more and $1\times10^{-1}$ or less ($1.33\times10^{-4}$ Pa or more and 13.3 Pa or less)), or in a gas such as nitrogen gas or argon gas.

The treatment temperature in the degreasing treatment is not particularly limited, but is preferably 100° C. or higher and 750° C. or lower, more preferably 150° C. or higher and 700° C. or lower.

The treatment time in the degreasing step is preferably 0.5 hours or more and 20 hours or less, more preferably 1 hour or more and 10 hours or less.

The degreasing by such a heat treatment may be performed by being divided into a plurality of stages for various purposes (for example, for the purpose of reducing the degreasing time, etc.). In this case, for example, a method in which degreasing is performed at a low temperature in the former half and at a high temperature in the latter half, a method in which degreasing at a low temperature and degreasing at a high temperature are alternately repeated, or the like can be used.

After the degreasing treatment as described above, the thus obtained degreased body may be subjected to any of various post-processing treatments for the purpose of, for example, deburring, forming a microstructure such as a groove, etc.

It is not necessary to completely remove the binder 22 and the binder 32 from the molded body by the degreasing treatment, and the binder may partially remain therein at the time of, for example, completion of the degreasing treatment.

Firing Step

Subsequently, the degreased body subjected to the degreasing treatment is fired. According to this, the degreased body is sintered, whereby a sintered body is obtained.

The firing conditions are not particularly limited, but the firing step is performed by performing a heat treatment in a non-oxidizing atmosphere, for example, under vacuum or a reduced pressure (for example, $1\times10^{-6}$ Torr or more and $1\times10^{-2}$ Torr or less ($1.33\times10^{-4}$ Pa or more and 133 Pa or less)), or in an inert gas such as nitrogen gas or argon gas. According to this, the oxidation of the metal powder can be prevented.

The firing step may be performed by being divided into two or more stages. According to this, sintering efficiency is improved, and firing can be performed in a shorter firing time.

The firing step may be performed continuously with the above-mentioned degreasing step. According to this, the degreasing step can also serve as a pre-sintering step, and therefore, preheating is applied to the degreased body and the degreased body can be more reliably sintered.

The firing temperature is appropriately set according to the constituent materials of the first metal particles 21 and the second metal particles 31. However, in the case of, for example, an Fe-based alloy, the firing temperature is preferably 1000° C. or higher and 1400° C. or lower, more preferably 1050° C. or higher and 1350° C. or lower.

The firing time is preferably 0.5 hours or more and 20 hours or less, more preferably 1 hour or more and 15 hours or less.

Such a firing step may be performed by being divided into a plurality of steps (stages) for various purposes (for example, for the purpose of reducing the firing time, etc.). In this case, for example, a method in which firing is performed at a low temperature in the former half and at a high temperature in the latter half, a method in which firing at a low temperature and firing at a high temperature are alternately repeated, or the like can be used.

After the firing step as described above, the thus obtained sintered body may be subjected to machining processing, electric discharge processing, laser processing, etching, or the like for the purpose of, for example, deburring, forming a microstructure such as a groove, etc.

The obtained sintered body may be subjected to an HIP treatment (hot isostatic press treatment) or the like as desired. According to this, the density of the sintered body can be further increased.

Sintered Body

Next, an embodiment of the sintered body according to the invention will be described.

Figure 3:
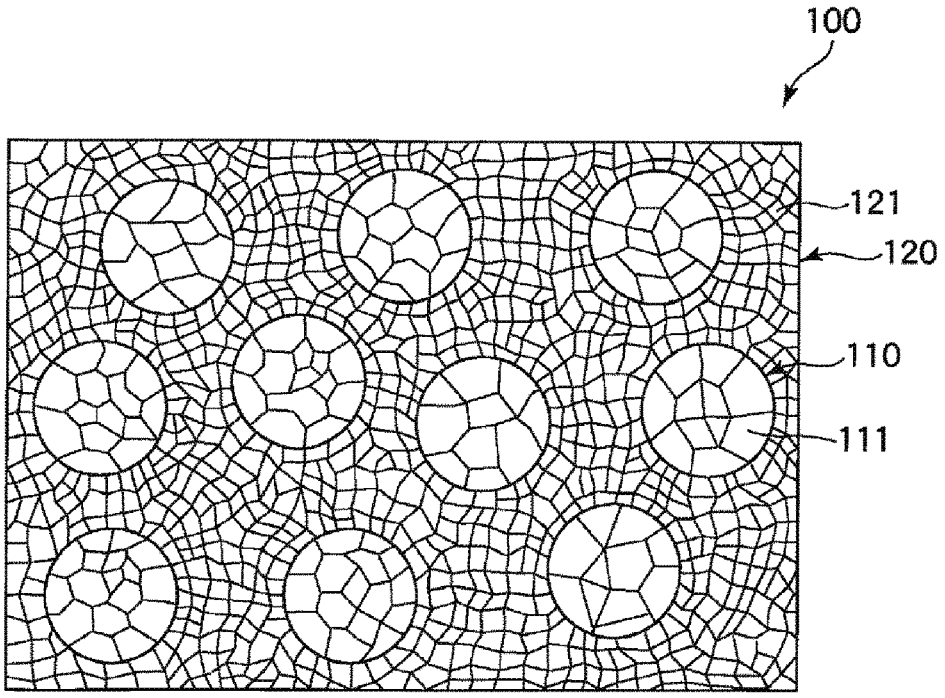
FIG. 3 is a cross-sectional view showing an embodiment of a sintered body according to the invention.

FIG. 3 is a cross-sectional view showing an embodiment of the sintered body according to the invention.

A sintered body 100 shown in FIG. 3 includes a first portion 110 including a sintered material of the first metal particles 21 and a second portion 120 including a sintered material of the second metal particles 31. Further, the average crystal grain diameter of the second portion 120 is smaller than the average crystal grain diameter of the first portion 110.

That is, the sintered body 100 includes the first portion 110 including a sintered material of the first metal particles 21 and the second portion 120 including a sintered material of the second metal particles 31 composed of the same constituent material as the first portion 110 and having a smaller average crystal grain diameter than the first portion 110. Such a sintered body 100 achieves both high mechanical strength and high ductility.

Hereinafter, the respective portions will be sequentially described in detail.

The first portion 110 includes a sintered material of the first metal particles 21. As shown in FIG. 3, such a first portion 110 includes a crystal structure 111 derived from the first metal particle 21.

Further, the first portion 110 has a strong tendency to inherit the shape of the secondary particle 2, and therefore is a region in the granular form. Due to this, in the same manner as the secondary particle 2 in the compound 1, the first portion 110 is present in a dispersed (scattered) manner in the matrix of the second portion 120.

On the other hand, the second portion 120 includes a sintered material of the second metal particles 31. As shown in FIG. 3, such a second portion 120 includes a crystal structure 121 derived from the second metal particle 31.

Further, the second portion 120 has a strong tendency to inherit the shape of the matrix region 3, and therefore is a region so as to encase the first portion 110.

Here, the constituent material of the first portion 110 and the constituent material of the second portion 120 are the same. Due to this, a thermal expansion difference hardly occurs between the first portion 110 and the second portion 120, and the occurrence of a crack or the like is suppressed. Therefore, the mechanical strength of the sintered body 100 is hardly decreased.

On the other hand, the average crystal grain diameter of the crystal structure 121 is smaller than the average crystal grain diameter of the crystal structure 111. Due to this, in the sintered body 100, a structure in which the second portion 120 including the crystal structure 121 having a relatively small grain diameter extends so as to encase the first portion 110 including the crystal structure 111 having a relatively large grain diameter is formed. In other words, while the second portion 120 extends like a net (network), the first portion 110 is distributed so as to penetrate into the meshes of the net. In such a structure, it is considered that high mechanical strength is obtained mainly by the second portion 120, and high ductility is obtained mainly by the first portion 110. Due to this, it is presumed that when stress occurs in the sintered body 100, by the expansion and contraction of the network structure of the second portion 120, collapse is less likely to occur, and on the other hand, the stress concentration is relaxed by the first portion 110 having high ductility. As a result, the sintered body 100 achieves both high mechanical strength and high ductility.

When the average crystal grain diameter of the crystal structure 111 is taken as 1, the average crystal grain diameter of the crystal structure 121 may be less than 1, but is set to preferably 0.005 or more and 0.9 or less, more preferably 0.01 or more and 0.5 or less, further more preferably 0.03 or more and 0.3 or less. By forming such a difference in grain diameter between the crystal structure 111 and the crystal structure 121, the balance of the mechanical strength is easily maintained between the first portion 110 and the second portion 120, and therefore, the mechanical strength of the sintered body 100 as a whole is hardly decreased. Specifically, high rigidity brought about by the crystal structure 121 mainly in the second portion 120, and high ductility brought about by the crystal structure 111 mainly in the first portion 110 are achieved in a well-balanced manner. That is, in the case where the crystal grain diameter is small, the existence ratio of the crystal grain boundary is high, and therefore, the rigidity tends to increase. On the other hand, in the case where the crystal grain diameter is large, dislocation in the crystal is likely to occur, and therefore, the ductility tends to increase. Due to this, by balancing these, the sintered body 100 which achieves both high mechanical strength and high ductility at a high level is obtained.

Further, by distributing the first portion 110 and the second portion 120 as described above, for example, as compared with the case where the entire sintered body 100 is occupied by the first portion 110 or the second portion 120, the mechanical strength can be further increased.

The average crystal grain diameter of the crystal structure 111 has a tendency to depend mainly on the particle diameter of the first metal particle 21, and the average crystal grain diameter of the crystal structure 121 has a tendency to depend mainly on the particle diameter of the second metal particle 31. For example, when the particle diameter of the first metal particle 21 or the second metal particle 31 is increased, the grain diameter of the crystal structure 111 or the crystal structure 121 has a tendency to increase accordingly. Therefore, the ratio of the average crystal grain diameter of the crystal structure 121 to the average crystal grain diameter of the crystal structure 111 can be adjusted by appropriately changing the particle diameter of the first metal particle 21 or the second metal particle 31 to be used in the production of the sintered body 100.

The average crystal grain diameter of the crystal structure 111 is not particularly limited, but is preferably about 1 μm or more and 30 μm or less, more preferably about 3 μm or more and 25 μm or less. According to this, sufficient ductility is imparted to the first portion 110.

The average crystal grain diameter of the crystal structure 121 is not particularly limited, but is preferably about 0.05 μm or more and 20 μm or less, more preferably about 0.1 μm or more and 10 μm or less. According to this, sufficient mechanical strength is imparted to the second portion 120.

Each of the average crystal grain diameter of the crystal structure 111 and the average crystal grain diameter of the crystal structure 121 is determined by, for example, a crystallographic analysis using an electron backscatter diffraction detector. Further, in the calculation of the average, 10 or more pieces of data are used.

The existence ratio of the first portion 110 to the second portion 120 is not particularly limited, but is preferably 0.01 or more and 100 or less, more preferably 0.1 or more and 70 or less, further more preferably more than 1 and 50 or less. According to this, the balance between the first portion 110 and the second portion 120 is further optimized, and therefore, the sintered body 100 which achieves both high mechanical strength and high ductility at a higher level is obtained.

This existence ratio is determined by calculating the ratio of an area occupied by the first portion 110 to an area occupied by the second portion 120 in the cross section of the sintered body 100.

The boundary between the first portion 110 and the second portion 120 can be specified based on a large difference in the grain diameter before and after the boundary. Therefore, the grain diameters of the respective crystal structures are determined by, for example, a crystallographic analysis using an electron backscatter diffraction detector, and color coding is done according to the grain diameter on the image, whereby the boundary can be specified according to the difference in color.

The shape of the first portion 110 is preferably a granular shape as described above, however, from the viewpoint of aspect ratio, the average of the major axis/the minor axis is preferably 1 or more and 3 or less, more preferably 1 or more and 2.5 or less, further more preferably 1 or more and 2 or less. The first portion 110 having such an aspect ratio has a shape with high isotropy, and therefore, collapse or the like is less likely to occur. Due to this, while sufficiently exhibiting the effect of high ductility, a decrease in mechanical strength is less likely to be caused. As a result, the sintered body 100 which achieves both high mechanical strength and high ductility at a higher level is obtained.

The aspect ratio of the first portion 110 is calculated by, for example, performing a crystallographic analysis using an electron backscatter diffraction detector with respect to the cross section of the sintered body 100, and determining the maximum length (major axis) of the first portion 110 and the maximum length (minor axis) in the direction orthogonal to the major axis on the obtained image of the crystallographic analysis (crystal grain map). Further, in the calculation of the average, 10 or more pieces of data are used.

In this case, the average diameter of the first portion 110 is preferably about 1.5 times or more and 100 times or less, more preferably about 2 times or more and 80 times or less, further more preferably about 3 times or more and 50 times or less of the average crystal grain diameter of the crystal structure 111. According to this, the size of the first portion 110 with respect to the grain diameter of the crystal structure 111 can be optimized, and therefore, the sintered body 100 which achieves both high mechanical strength and high ductility at a higher level is obtained.

The average diameter of the first portion 110 is calculated by, for example, performing a crystallographic analysis using an electron backscatter diffraction detector with respect to the cross section of the sintered body 100, and determining the maximum length (major axis) of the first portion 110 on the obtained image of the crystallographic analysis (crystal grain map). Further, in the calculation of the average, 10 or more pieces of data are used.

In the sintered body 100, a portion other than the first portion 110 and the second portion 120 may be included.

Metal Powder Molded Body

Next, an embodiment of the metal powder molded body according to the invention will be described.

The metal powder molded body (hereinafter, also simply referred to as "molded body" for short) according to this embodiment is a molded body produced by press molding.

Figure 4:
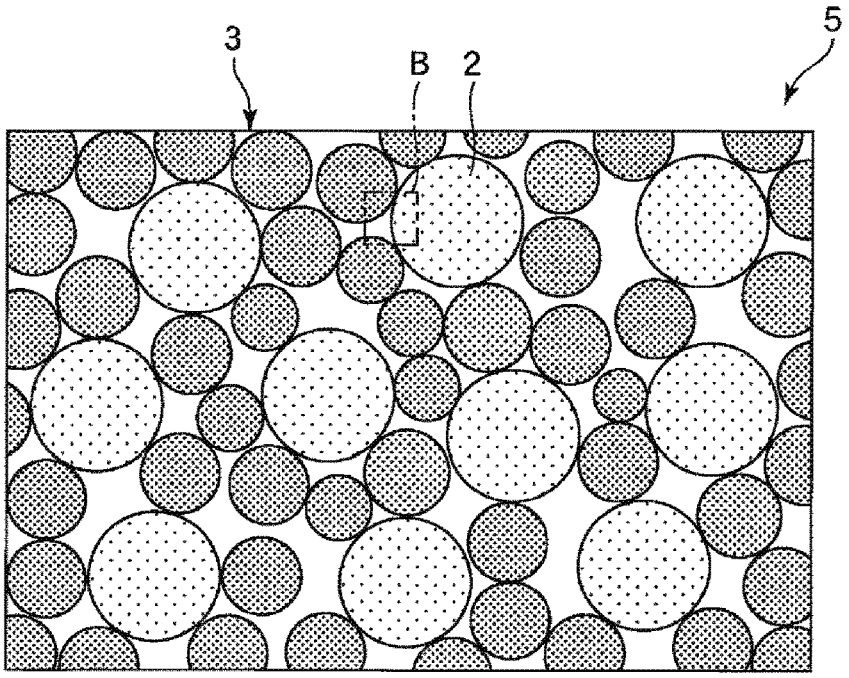
FIG. 4 is a cross-sectional view showing an embodiment of a metal powder molded body according to the invention.
Figure 5:
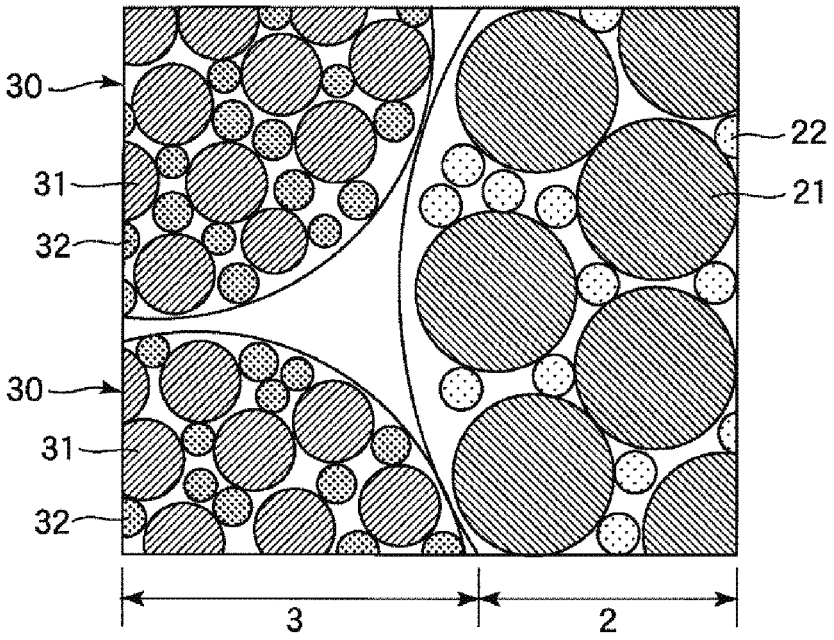
FIG. 5 is an enlarged view of portion B of FIG. 4.

FIG. 4 is a cross-sectional view showing an embodiment of the metal powder molded body according to the invention, and FIG. 5 is an enlarged view of portion B of FIG. 4. In FIGS. 4 and 5, components having the same configurations as in FIGS. 1 and 2 described above are denoted by the same reference numerals. Further, the description of the same configurations as in FIGS. 1 and 2 will be omitted here.

A molded body 5 shown in FIGS. 4 and 5 includes secondary particles 2 in which first metal particles 21 are bound to one another and a matrix region 3 including a binder and second metal particles 31 composed of the same constituent material as the first metal particles 21 and having a smaller average particle diameter than the first metal particles 21. According to such a molded body 5, a molded body 5 (metal powder molded body) capable of producing a sintered body 100 which achieves both high mechanical strength and high ductility is obtained in the same manner as the compound 1.

In the above-mentioned compound 1, as shown in FIG. 2, the matrix region 3 is constituted by distributing the binder 22 so that the gaps between the first metal particles 21 are almost filled therewith. On the other hand, as shown in FIG. 5, the matrix region 3 of the molded body 5 has a structure with gaps between the first metal particles 21 and between the first metal particle 21 and the binder 22. That is, in the compound 1 and the molded body 5, elements to be included are the same, but the forms (structures) are mutually different.

In the secondary particle 2 shown in FIG. 5, the first metal particles 21 are bound to one another through the binder 22.

On the other hand, in the matrix region 3 shown in FIG. 5, the second metal particles 31 are bound to one another through the binder 32.

In the molded body 5 including such secondary particles 2 and the matrix region 3, an aggregate of the first metal particles 21 is surrounded by the second metal particles 31 having a smaller average particle diameter than the first metal particles 21. The molded body 5 in such a form is further fired to form a sintered body. Such a sintered body achieves both high mechanical strength and high ductility as described above.

In other words, since the secondary particles 2 in the granular form are present inside the matrix region 3, the shape retainability of the molded body 5 is easily maintained. Due to this, for example, even if the content of the binder 32 in the matrix region 3 is reduced, the deformation of the molded body 5 is suppressed, and therefore, the shrinkage ratio of the molded body during firing is suppressed, and a sintered body having high dimensional accuracy is obtained in the end.

The existence ratio of the secondary particles 2 in the matrix region 3 is not particularly limited, but is preferably 0.01 or more and 100 or less, more preferably 0.1 or more and 70 or less, further more preferably more than 1 and 50 or less. According to this, the balance between the secondary particles 2 and the matrix region 3 is further optimized, and therefore, both high mechanical strength and high ductility can be achieved at a higher level in the sintered body.

The existence ratio of the secondary particles 2 can be determined by calculating the ratio of an area occupied by the secondary particles 2 to an area occupied by the matrix region 3 in the cross section of the molded body 5.

Secondary Particle

The secondary particle 2 shown in FIG. 5 includes a plurality of first metal particles 21 and the binder 22. The secondary particle 2 shown in FIG. 5 has the same configuration as the secondary particle 2 shown in FIG. 2, and therefore, the description thereof will be omitted.

Matrix Region

The matrix region 3 shown in FIG. 5 includes the binder 32 and the second metal particles 31 composed of the same constituent material as the first metal particles 21 and having a smaller average particle diameter than the first metal particles 21.

That is, the matrix region 3 is an aggregate of granulated particles 30 obtained by binding the second metal particles 31 through the binder 32.

In the molded body 5 including such secondary particles 2 and the matrix region 3, an aggregate of the first metal particles 21 is surrounded by the second metal particles 31 having a smaller average particle diameter than the first metal particles 21 in the same manner as the compound 1. The molded body 5 in such a form is further fired to form a sintered body. Such a sintered body achieves both high mechanical strength and high ductility as described above.

The binder 32 to be used in the matrix region 3 is not particularly limited as long as it has a binding property, however, particularly, components as described as the binder 22 are preferably used. These components have a high binding property, and therefore, even if the component is used in a relatively small amount, the granulated particles 30 can be efficiently formed. Further, such a component also has high thermal decomposability, and therefore can be reliably decomposed and removed in a short time during degreasing and firing.

The average diameter of the granulated particles 30 is preferably about 1.5 times or more and 100 times or less, more preferably about 2 times or more and 80 times or less, further more preferably about 3 times or more and 50 times or less of the average particle diameter of the second metal particles 31. According to this, the balance between the particle diameter of the granulated particles 30 and the particle diameter of the second metal particles 31 is optimized. As a result, the granulated particles 30 themselves are still less likely to collapse, and therefore, the shape retainability of the molded body 5 can be further enhanced.

The average diameter of the granulated particles 30 is obtained by, for example, acquiring an observation image of the cross section of the molded body 5 by an electron microscope, and determining the diameter as the diameter of a true circle (circle equivalent diameter) having the same area as that of the granulated particle 30 on the image. In the calculation of the average, 10 or more pieces of data are used. Further, according to need, an elemental mapping image may be used so as to facilitate the recognition of the contour of the granulated particle 30.

Further, to the matrix region 3, a component other than the second metal particles 31 and the binder 32, for example, any of various additives such as a solvent (dispersion medium), an anti-rust agent, an antioxidant, a dispersant, and an anti-foaming agent may be added. The additional amount of such an additive is preferably about 5 mass % or less, more preferably about 3 mass % or less of the matrix region 3.

Hereinabove, the invention has been described with reference to preferred embodiments, however, the invention is not limited thereto. For example, in the compound for metal powder injection molding or the metal powder molded body, two or more types of secondary particles may be included.

EXAMPLES

Next, specific Examples of the invention will be described.

1. Production of Sintered Body

Example 1

<1> Production of Secondary Particles

First, as first metal particles, an austenitic stainless steel powder (SUS316L) having an average particle diameter of 10 μm produced by a water atomization method was prepared.

On the other hand, as a binder, polyvinyl alcohol (PVA-117, manufactured by Kuraray Co., Ltd.) was prepared. Further, as a solvent, ion exchanged water was prepared. The additional amount of the solvent was set to 50 g per g of the binder.

Subsequently, polyvinyl alcohol was mixed with ion exchanged water, and the resulting mixture was cooled to room temperature, whereby a binder solution was prepared. The mixing ratio of the binder to the first metal particles is as shown in Table 1.

Subsequently, the first metal particles and the binder solution were mixed, whereby a slurry was prepared.

Subsequently, the slurry was placed in a spray dryer and granulated, whereby secondary particles having an average particle diameter of 75 μm were obtained.

<2> Production of Compound

First, as second metal particles, an austenitic stainless steel powder (SUS316L) having an average particle diameter of 4 μm produced by a water atomization method was prepared.

On the other hand, as a binder, a binder having a composition shown in Table 1 was prepared.

Subsequently, the second metal particles and the binder were mixed and kneaded under the conditions of 100° C. for 60 minutes in a pressure kneader (kneading machine). This kneading was performed in a nitrogen atmosphere. The mixing ratio of the binder to the second metal particles is as shown in Table 1.

Subsequently, the secondary particles were added to the thus obtained kneaded material, and kneading was performed again. By doing this, a matrix region is formed, and also a compound was obtained.

Subsequently, the obtained compound was crushed by a pelletizer (registered trademark), whereby pellets having an average particle diameter of 5 mm were obtained.

<3> Production of Sintered Body

Subsequently, by using the obtained pellets, molding was performed by an injection molding machine under the following molding conditions: material temperature: 130° C., injection pressure: 10.8 MPa (110 kgf/cm$^2$). By doing this, a molded body was obtained. The shape of the molded body was a disk shape with a diameter of 20 mm and a thickness of 5 mm.

Subsequently, the molded body was subjected to a degreasing treatment under the following degreasing conditions: temperature: 500° C., time: 1 hour, atmosphere: nitrogen gas (atmospheric pressure). By doing this, a degreased body was obtained.

Subsequently, the degreased body was subjected to a firing treatment under the following firing conditions: temperature: 1270° C., time: 3 hours, atmosphere: nitrogen gas (atmospheric pressure). By doing this, a sintered body was obtained.

Example 2

<1> Production of Secondary Particles

First, secondary particles were obtained in the same manner as in Example 1.

<2> Production of Granulated Particles for Matrix Region

Subsequently, as second metal particles, an austenitic stainless steel powder (SUS316L) having an average particle diameter of 4 μm produced by a water atomization method was prepared.

On the other hand, as a binder, polyvinyl alcohol (PVA-117, manufactured by Kuraray Co., Ltd.) was prepared. Further, as a solvent, ion exchanged water was prepared. The additional amount of the solvent was set to 50 g per g of the binder.

Subsequently, polyvinyl alcohol was mixed with ion exchanged water, and the resulting mixture was cooled to room temperature, whereby a binder solution was prepared.

Subsequently, the second metal particles and the binder solution were mixed, whereby a slurry was prepared.

Subsequently, the slurry was placed in a spray dryer and granulated, whereby granulated particles for the matrix region having an average particle diameter of 50 μm were obtained.

<3> Production of Sintered Body

Subsequently, the secondary particles and the granulated particles were mixed, and the resulting material was molded under the following molding conditions, whereby a molded body was obtained. The shape of the molded body was a disk shape with a diameter of 20 mm and a thickness of 5 mm.

Molding Conditions

Molding method: press molding

Molding pressure: 100 MPa (1 t/cm$^2$)

Subsequently, the molded body was subjected to a degreasing treatment under the following degreasing conditions: temperature: 500° C., time: 1 hour, atmosphere: nitrogen gas (atmospheric pressure), whereby a degreased body was obtained.

Subsequently, the degreased body was subjected to a firing treatment under the following firing conditions: temperature: 1270° C., time: 3 hours, atmosphere: nitrogen gas (atmospheric pressure). By doing this, a sintered body was obtained.

Example 3

A sintered body was obtained in the same manner as in Example 1 except that the heating treatment was performed by placing the obtained secondary particles in a heating furnace. The conditions for the heating treatment are as follows.

Heating Conditions

Heating temperature: 500° C.

Heating time: 60 minutes

Heating atmosphere: nitrogen atmosphere

Example 4

A sintered body was obtained in the same manner as in Example 2 except that the heating treatment was performed by placing the obtained secondary particles in a heating furnace. The conditions for the heating treatment are as follows.

Heating Conditions

Heating temperature: 500° C.

Heating time: 60 minutes

Heating atmosphere: nitrogen atmosphere

Examples 5 to 13

A sintered body was obtained in the same manner as in Example 1 except that the production conditions were changed as shown in Table 2.

Comparative Example 1

A sintered body was obtained in the same manner as in Example 1 except that the compound was produced only with the matrix region.

Comparative Example 2

A sintered body was obtained in the same manner as in Example 2 except that the molded body was produced only with the secondary particles.

2. Evaluation of Sintered Body 2.1 Evaluation of Tensile Strength

With respect to the sintered bodies obtained in the respective Examples and the respective Comparative Examples, the tensile strength was measured using test pieces specified in ISO 2740:2009 in accordance with the test method specified in JIS Z 2241:2011.

Then, the tensile strength of the sintered body obtained in Comparative Example 2 was taken as 1, and the relative values of the tensile strength of the sintered bodies obtained in the respective Examples and Comparative Example 1 were calculated.

Then, the calculated relative values were evaluated in light of the following evaluation criteria.

Evaluation Criteria for Tensile Strength

A: The tensile strength is very high (the relative value is more than 1.1).

B: The tensile strength is high (the relative value is more than 1 and 1.1 or less).

C: The tensile strength is low (the relative value is more than 0.9 and 1 or less).

D: The tensile strength is very low (the relative value is 0.9 or less).

The evaluation results are shown in Tables 1 and 2.

2.2 Evaluation of Elongation

With respect to the sintered bodies obtained in the respective Examples and the respective Comparative Examples, the elongation was measured using test pieces specified in ISO 2740:2009 in accordance with the test method specified in JIS Z 2241:2011.

Then, the elongation of the sintered body obtained in Comparative Example 2 was taken as 1, and the relative values of the elongation of the sintered bodies obtained in the respective Examples and Comparative Example 1 were calculated.

Then, the calculated relative values were evaluated in light of the following evaluation criteria.

Evaluation Criteria for Elongation

A: The elongation is very high (the relative value is more than 1.1).

B: The elongation is high (the relative value is more than 1 and 1.1 or less).

C: The elongation is low (the relative value is more than 0.9 and 1 or less).

D: The elongation is very low (the relative value is 0.9 or less).

The evaluation results are shown in Tables 1 and 2.

TABLE 1

| | | | | | Example 1 | Example 2 | Example 3 | Example 4 | Comparative example 1 | Comparative example 2 |
|---|---|---|---|---|---|---|---|---|---|---|
| Secondary particles | First metal particles | Stainless steel powder | Average particle diameter: 10 μm | vol % | 90 | 90 | 90 | 90 | | 90 |
| | Binder | Polyvinyl alcohol | | vol % | 10 | 10 | 10 | 10 | | 10 |
| | Particle diameter of secondary particles | | | μm | 75 | 75 | 75 | 75 | | 75 |
| | Heating treatment | | | — | without | without | with | with | | without |
| Matrix region | Second metal particles | Stainless steel powder | Average particle diameter: 4 μm | vol % | 68 | 90 | 68 | 90 | 68 | |
| | Binder | The following mixture | | vol % | 32 | 10 | 32 | 10 | 32 | |
| | Composition of binder | Hydrocarbon-based polymer | Polystyrene | mass % | 30 | | 30 | | 30 | |
| | | Wax | Paraffin wax | mass % | 28 | | 28 | | 28 | |
| | | Cyclic ether group-containing copolymer | E-GMA-VA | mass % | 26 | | 26 | | 26 | |
| | | Others | Dibutyl phthalate | mass % | 16 | | 16 | | 16 | |
| | | | Polyvinyl alcohol | mass % | | 100 | | 100 | | |
| | Total | | | mass % | 100 | 100 | 100 | 100 | 100 | — |
| | Particle diameter of granulated particles | | | μm | — | 50 | — | 50 | — | — |
| Compound or molded body | Secondary particles | | | % | 70 | 70 | 70 | 70 | 0 | 100 |
| | Matrix region | | | % | 30 | 30 | 30 | 30 | 100 | 0 |
| Evaluation results of sintered body | First portion | Average crystal grain diameter | | μm | 7 | 5 | 6 | 4 | — | — |
| | | Average of aspect ratio | | — | 1.5 | 1.8 | 1.2 | 1.4 | — | — |
| | | Average diameter | | μm | 45 | 40 | 55 | 50 | — | — |
| | Second portion | Average crystal grain diameter | | μm | 1 | 0.5 | 0.8 | 0.4 | 0.5 | 5 |
| | Tensile strength | | | — | A | A | A | A | B | C |
| | Elongation | | | — | A | A | A | A | D | C |

TABLE 2

| | | | | | Example 5 | Example 6 | Example 7 | Example 8 |
|---|---|---|---|---|---|---|---|---|
| Secondary particles | First metal particles | Stainless steel powder | Average particle diameter: 10 μm | vol % | 90 | 88 | 92 | 90 |
| | Binder | Polyvinyl alcohol | | vol % | 10 | 12 | 8 | 10 |
| | Particle diameter of secondary particles | | | μm | 75 | 71 | 79 | 75 |
| | Heating treatment | | | — | with | with | with | with |
| Matrix region | Second metal particles | Stainless steel powder | Average particle diameter: 4 μm | vol % | 68 | 66 | 70 | 68 |
| | Binder | The following mixture | | vol % | 32 | 34 | 30 | 32 |
| | Composition of binder | Hydrocarbon-based polymer | Polystyrene | mass % | 30 | 30 | 30 | 30 |
| | | Wax | Paraffin wax | mass % | 28 | 28 | 28 | 28 |
| | | Cyclic ether group-containing copolymer | E-GMA-VA | mass % | 26 | 26 | 26 | 26 |
| | | Others | Dibutyl phthalate | mass % | 16 | 16 | 16 | 16 |
| | | | Polyvinyl alcohol | mass % | | | | |
| | Total | | | mass % | 100 | 100 | 100 | 100 |
| | Particle diameter of granulated particles | | | μm | — | — | — | — |
| Compound or molded body | Secondary particles | | | % | 10 | 20 | 30 | 40 |
| | Matrix region | | | % | 90 | 80 | 70 | 60 |

TABLE 2-continued

| | | | | | | | |
|---|---|---|---|---|---|---|---|
| Evaluation results of sintered body | First portion | Average crystal grain diameter | μm | 7 | 5 | 6 | 4 |
| | | Average of aspect ratio | — | 1.5 | 1.8 | 1.2 | 1.4 |
| | | Average diameter | μm | 45 | 40 | 55 | 50 |
| | Second portion | Average crystal grain diameter | μm | 1 | 0.5 | 0.8 | 0.4 |
| | | Tensile strength | — | B | B | A | A |
| | | Elongation | — | A | A | A | A |

| | | | | Example 9 | Example 10 | Example 11 | Example 12 | Example 13 |
|---|---|---|---|---|---|---|---|---|
| Secondary particles | First metal particles | Stainless steel powder | Average particle diameter: 10 μm | 90 | 90 | 90 | 88 | 92 |
| | Binder | Polyvinyl alcohol | | 10 | 10 | 10 | 12 | 8 |
| | Particle diameter of secondary particles | | | 75 | 75 | 75 | 71 | 79 |
| | Heating treatment | | | with | with | with | with | with |
| Matrix region | Second metal particles | Stainless steel powder | Average particle diameter: 4 μm | 68 | 68 | 68 | 66 | 70 |
| | Binder | The following mixture | | 32 | 32 | 32 | 34 | 30 |
| | Composition of binder | Hydrocarbon-based polymer | Polystyrene | 30 | 30 | 30 | 30 | 30 |
| | | Wax | Paraffin wax | 28 | 28 | 28 | 28 | 28 |
| | | Cyclic ether group-containing copolymer | E-GMA-VA | 26 | 26 | 26 | 26 | 26 |
| | | Others | Dibutyl phthalate<br>Polyvinyl alcohol | 16 | 16 | 16 | 16 | 16 |
| | Total | | | 100 | 100 | 100 | 100 | 100 |
| | Particle diameter of granulated particles | | | — | — | — | — | — |
| Compound or molded body | Secondary particles | | | 50 | 60 | 80 | 90 | 97 |
| | Matrix region | | | 50 | 40 | 20 | 10 | 3 |
| Evaluation results of sintered body | First portion | Average crystal grain diameter | | 3 | 8 | 4 | 6 | 9 |
| | | Average of aspect ratio | | 2.5 | 2.9 | 1.4 | 1.8 | 1.9 |
| | | Average diameter | | 80 | 75 | 50 | 65 | 60 |
| | Second portion | Average crystal grain diameter | | 0.5 | 1.5 | 0.4 | 0.5 | 0.9 |
| | | Tensile strength | | A | A | A | A | B |
| | | Elongation | | A | A | A | A | A |

As apparent from Tables 1 and 2, it was confirmed that the sintered bodies obtained in the respective Examples have favorable tensile strength and elongation.

When sintered bodies were produced in the same manner as described above also for an Ni-based alloy, a Co-based alloy, and a Ti-based alloy other than the examples shown in the tables, sintered bodies having favorable tensile strength and elongation were obtained in the same manner as described above for all the alloys.

The entire disclosure of Japanese Patent Application No. 2017-033916 filed Feb. 24, 2017 is expressly incorporated herein by reference.

What is claimed is:

1. A compound for metal powder injection molding, comprising:

first metal particles bound to one another to form secondary particles, the first metal particles being bound to one another and collectively encapsulated by a first binder; and second metal particles dispersed within a second binder to form a mixture;

the secondary particles being mixed into the mixture such that the secondary particles are bound together and collectively encapsulated by the second binder;

the second binder being different from the first binder;

the second metal particles being composed of a same constituent material as the first metal particles; and the second metal particles having a smaller average particle diameter than the first metal particles.

2. The compound for metal powder injection molding according to claim 1, wherein the constituent material of the first metal particles is any of an Fe-based alloy, an Ni-based alloy, and a Co-based alloy.

3. The compound for metal powder injection molding according to claim 1, wherein the first metal particles are bound to one another in the secondary particles via a second binder.

4. The compound for metal powder injection molding according to claim 1, wherein the first metal particles in the secondary particles are adhered to one another.

5. The compound for metal powder injection molding according to claim 1, wherein the secondary particles are dispersed in the mixture of the second metal particles and the binder.

6. A metal powder molded body, comprising:

granulated particles; and secondary particles molded with the granulated particles, the secondary particles being composed of first metal particles that are bound to one another and collectively encapsulated by a first binder; and the granulated particles being composed of second metal particles and a second binder, the secondary particles being dispersed throughout and entirely encapsulated by the second binder, the second metal particles being composed of a same constituent material as the first metal particles, the second metal particles having a smaller average particle diameter than the first metal particles.

7. A sintered body, comprising:

a plurality of first portions that each include a sintered material of first metal particles; and a second portion that entirely encapsulates each of the plurality of first portions, the second portion including a sintered material of second metal particles composed of a same constituent material as the first portion, the second metal particles having a smaller average crystal grain diameter than the first portion.

* * * * *